US007367844B2

(12) United States Patent
Xu

(10) Patent No.: US 7,367,844 B2
(45) Date of Patent: May 6, 2008

(54) UNIVERSAL CONNECTOR FOR MICRO MEMORY CARDS

(75) Inventor: Yingzan Xu, Dongguan (CN)

(73) Assignee: Just Make Electronics Co., Ltd. (CN)

( * ) Notice: Subject to any disclaimer, the term of this patent is extended or adjusted under 35 U.S.C. 154(b) by 0 days.

(21) Appl. No.: 11/775,385

(22) Filed: Jul. 10, 2007

(65) Prior Publication Data

US 2008/0070445 A1 Mar. 20, 2008

(30) Foreign Application Priority Data

Sep. 15, 2006 (CN) ..... 2006 2 0014753 U

(51) Int. Cl.
*H01R 29/00* (2006.01)

(52) U.S. Cl. ..... 439/630

(58) Field of Classification Search ..... 439/630
See application file for complete search history.

(56) References Cited

U.S. PATENT DOCUMENTS 6,540,523 B1 * 4/2003 Kung et al. ..... 439/64
6,716,066 B1 * 4/2004 Kuo ..... 439/630
6,749,450 B1 * 6/2004 Chen ..... 439/188
6,761,320 B1 * 7/2004 Chen ..... 235/492
6,761,572 B1 * 7/2004 Chou ..... 439/188

* cited by examiner

*Primary Examiner*—Tho D. Ta
(74) *Attorney, Agent, or Firm*—McDonnell Boehnen Hulbert & Berghoff LLP

(57) ABSTRACT

A universal connector for micro memory cards comprises: an insulating body having a inserting port provided at the front end of the insulating body so as to allow the memory cards to be inserted into a receiving cavity formed inside the insulating body; a first set of conductive terminals comprising ten conductive terminals for coupling a micro MMC card, wherein, second ends of the coupling terminals extend beyond the front end of the insulating body; a second set of conductive terminals comprising eight conductive terminals for coupling a micro SD card, wherein, second ends of the conductive terminals extend beyond the rear end of the insulating body; a third set of conductive terminals comprising eleven conductive terminals for coupling a micro MS card, wherein, second ends of the conductive terminals extend beyond the rear end of the insulating body; wherein, the second ends of the first set of the conductive terminals, the second set of conductive terminals and the third set of conductive terminals comprise contact surfaces/contact pins for being mounted at the bottom surface of the insulating body. The universal connector can be compatibly used for the current three standards of the micro memory cards.

10 Claims, 5 Drawing Sheets

UNIVERSAL CONNECTOR FOR MICRO MEMORY CARDS

TECHNICAL FIELD

The present invention relates to a connector, in particular to a connector used for compatibly connecting with more than two different types of matchable elements.

BACKGROUND ART

The current connector used for compatibly connecting with more than two different types of the matchable elements is widely utilized in electronic devices, for connecting the main circuit of electronic devices to different standards of flash memory card which serves as information storage medium.

Among various flash memory cards, SD cards, MMC cards and memory rods play main role as three standard products. The micro type products have the smallest dimensions of these types. With respect to length×width×thickness in the unit of millimeter, the micro SD card is dimensioned as 15 mm×11 mm×1 mm, the micro MMC card is dimensioned as 14 mm×12 mm×1.1 mm, the micro memory rod is dimensioned as 15 mm×12.5 mm×1.2 mm. Although these three types of products have similar sizes, due to different standards, the micro SD card has eight contact pieces, the micro MMC card has ten contact pieces, and a micro memory rod has eleven contact pieces.

The Chinese patent CN200420095169.1 discloses a universal receptacle for memory cards comprising a base made of insulating material; wherein, a front end of the header is provided with step-shaped inserting grooves forming a receiving space for inserting different types of memory cards. In the receiving space, first conductive terminals and second conductive terminals respectively for inserting SM cards and MS cards are oppositely provided at a rear end of the base; and in the multiple slots at the front end of the base, third conductive terminals are provided compatibly for both SD cards and MMC cards. Each type of the conductive terminals is disposed in the areas spaced from each other so as to connect with the corresponding memory cards.

The Chinese patent CN03209122.2 discloses a dual-purposes connector for memory cards wherein the connector includes a lower base and a top casing. A fool-proof protrusion and an orientation clipping arm respectively corresponding to a fool-proof slot and an orientation notch of the MS Duo card are provided inside the lower base. A plurality of front conductive pieces corresponding to the pieces of the MS Duo cards and a plurality of rear conductive pieces corresponding to the conductive pieces of the mini SD cards, as well as a detecting piece and a grounding piece corresponding to the inserting depth of the mini SD cards are further inlaid inside the lower base. Several fastening pieces for assembly are provided on the periphery of the lower base. Several fastening holes corresponding to the fastening pieces of the lower base are provided on the top casing. Several pressing pieces corresponding to the orientation notches of the mini SD cards are formed on the top surface of the casing in a shape of an orientation concave arc.

The Chinese patent CN200420007132.9 discloses an improved terminal structure, in which a main body is provided outwards with a slot opening at one end thereof for inserting a memory card, and is provided with terminal ports or terminal seats at the other end thereof for respectively connecting a first terminal of the SMC card, a second terminal of the MS card and a third terminal of the SD card.

The body portion of each terminal is provided backwards with a support leg, a tailing end of each support leg is bent to form a welding segment, each support leg of the first terminal, the second terminal and the third terminal is deviated towards one side (the left side or the right side) of the body portion of the respective terminal and bent so that these support legs are not be contacted with each other, and thus the welding segments of the three terminals are aligned with each other.

In these prior arts, although more than two different flash memory cards can be compatibly applied to one electronic device; it is not satisfied that three standards of micro memory cards can be compatibly applied to one electronic device.

SUMMARY OF THE INVENTION

The present invention is directed to overcome the deficiencies in the prior art and provides a connector which can be used in the current electrical devices for compatibly inserting three standards of micro memory cards.

In order to achieve the above objective, the present invention provides a universal connector for micro memory cards comprising an insulating body having top and bottom planes, left and right sides, front and rear ends to form a cavity for receiving the memory cards, and being provided with an inserting port at the front end thereof so as to allow the memory cards to be inserted into the cavity; a first set of conductive terminals comprising ten conductive terminals for coupling a micro MMC card, wherein each conductive terminal is horizontally arranged, and comprises a first end which is disposed in the cavity of the insulating body for receiving the memory cards and a second end which extends beyond the front end of the insulating body; a second set of conductive terminals comprising eight conductive terminals for coupling a micro SD card, wherein each conductive terminal is horizontally arranged, and comprises a first end which is disposed in the cavity of the insulating body for receiving the memory cards and a second end which extends beyond the rear end of the insulating body; a third set of conductive terminals comprising eleven conductive terminals for coupling a micro MS card, wherein each conductive terminal is horizontally arranged, and comprises a first end which is disposed in the cavity of the insulating body for receiving the memory cards and a second end which extends beyond the rear end of the insulating body; wherein the second ends of the conductive terminals of the first set, the conductive terminals of the second set and the conductive terminals of the third set comprise contact surfaces for being surface-welded to a print circuit board or contact pins for being in-line welded to a print circuit board, at the bottom surface of the insulating body.

Compared with the prior art, the universal connector for micro memory cards according to the invention may be used in the electronic device for compatibly inserting the three standards of micro memory cards.

BRIEF DESCRIPTION OF THE DRAWINGS

FIGS. 8*a*~8*c* are schematically plan views of the universal connectors for micro memory cards according to the invention; wherein, FIG. 8*a* is to show the state that a Micro MS card is inserted into the universal connector for micro memory cards according to the invention; FIG. 8*b* is to show the state that a Micro MMC card is inserted into the universal connector for micro memory cards according to the invention; FIG. 8*c* is to show the state that a Micro SD card is inserted into the universal connectors for micro memory cards according to the invention.

DETAILED DESCRIPTION OF THE PREFERRED EMBODIMENTS

Figure 1:
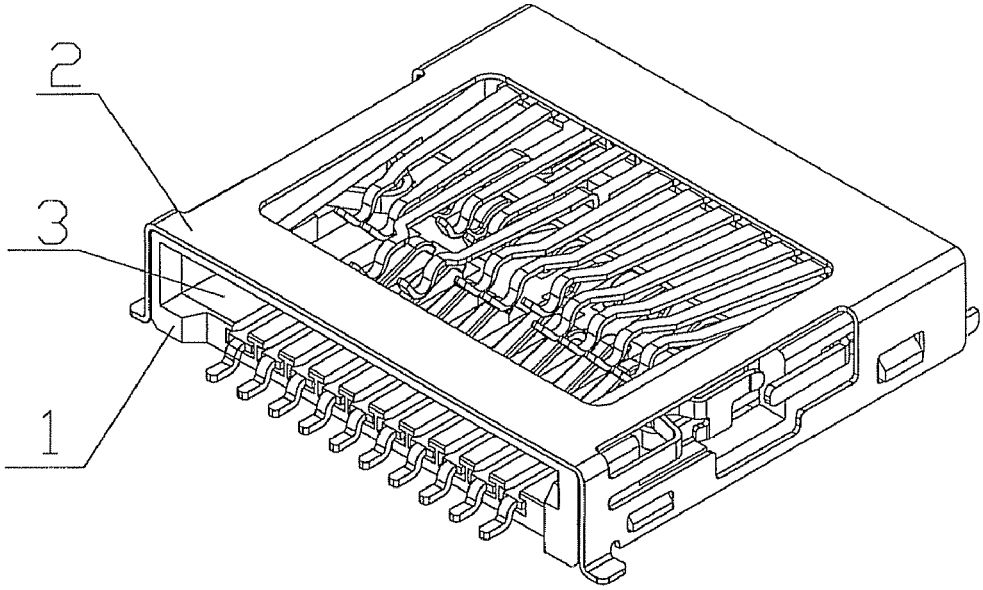
FIG. 1 is a schematically perspective view of one embodiment of the universal connector for micro memory cards according to the invention.
Figure 2:
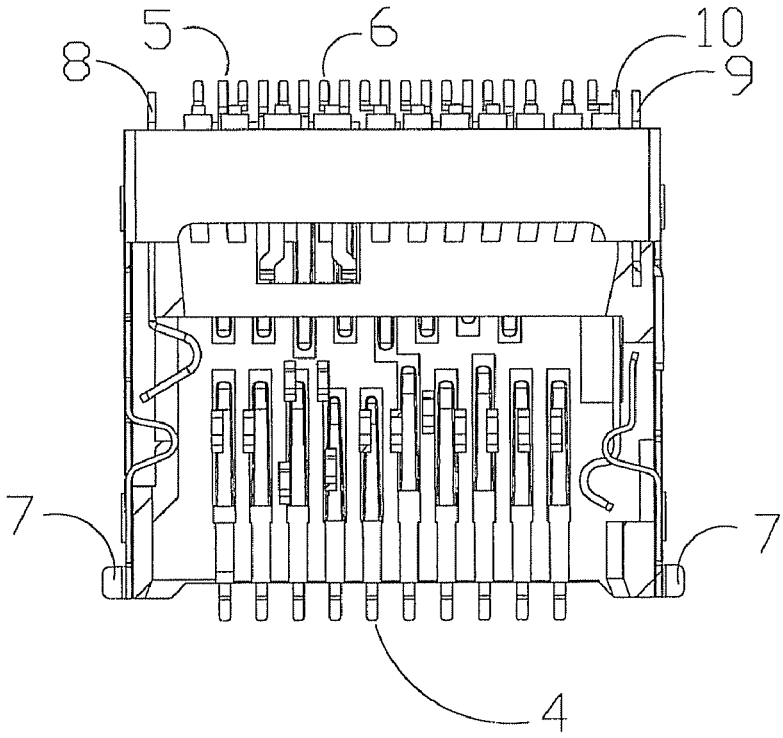
FIG. 2 is a schematically plan view of one embodiment of the universal connector for micro memory cards according to the invention.
Figure 3:
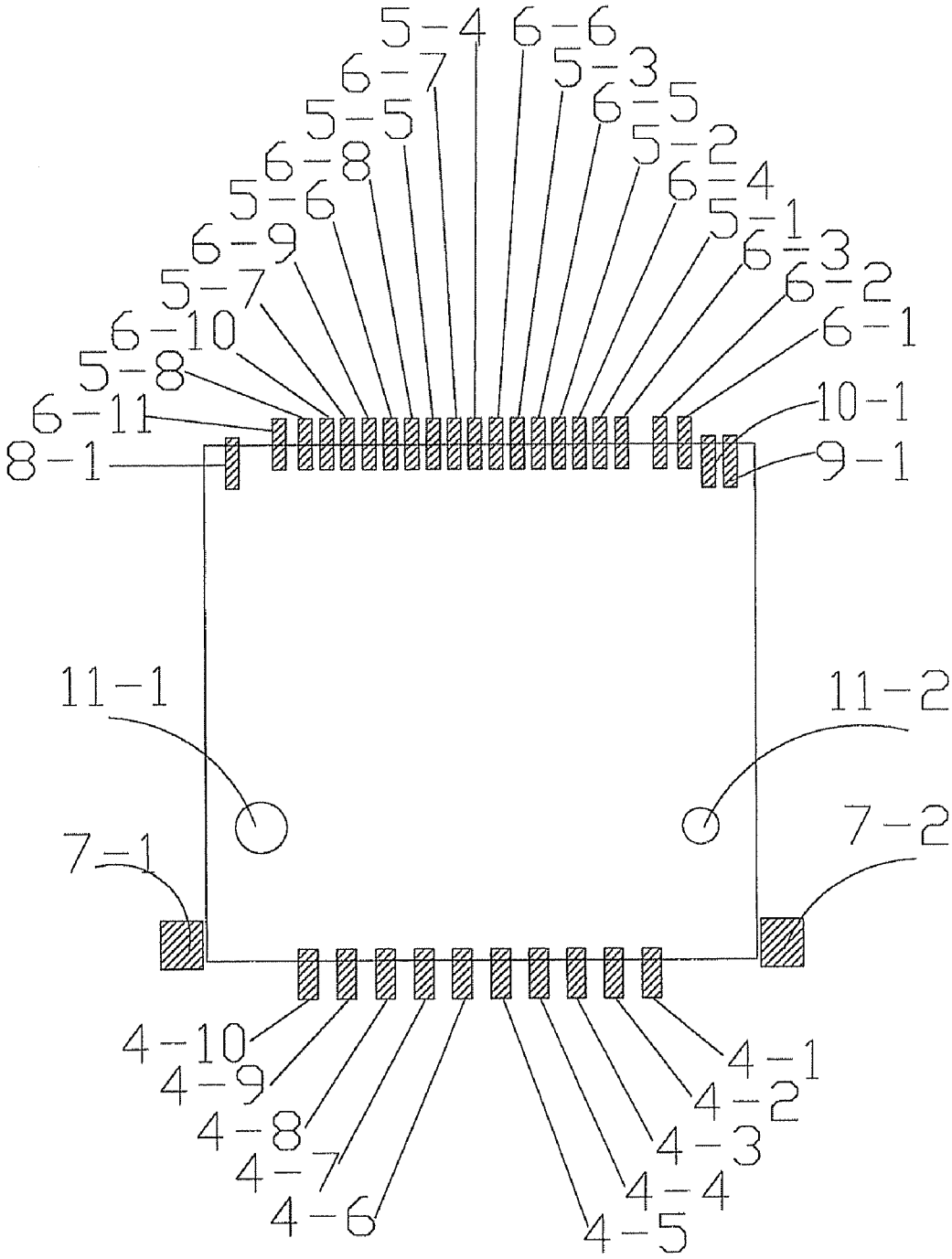
FIG. 3 is a layout of a typical print circuit board used in the universal connector for micro memory cards according to the invention.
Figure 4:
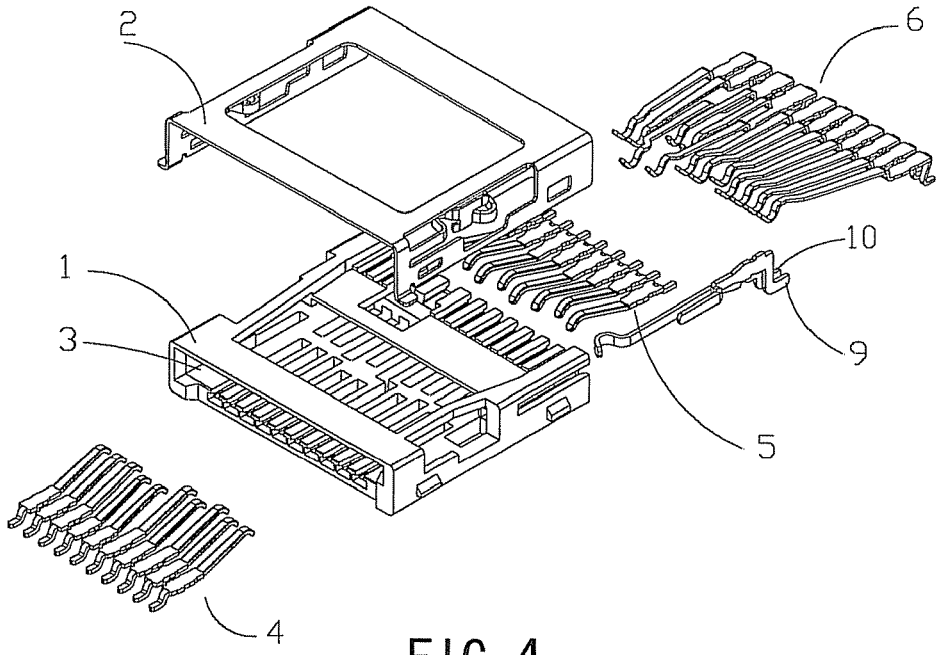
FIG. 4 is a schematically exploded perspective view of the structure of one embodiment of the universal connector for micro memory cards according to the invention.
Figure 5:
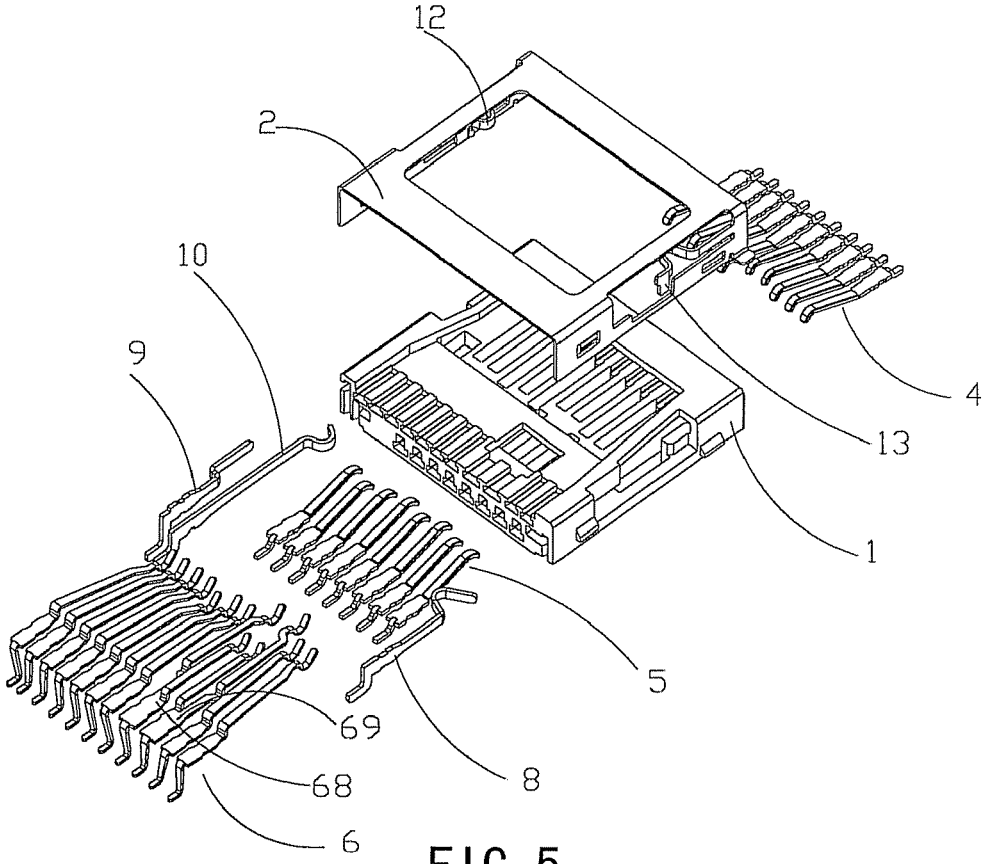
FIG. 5 is another schematically exploded perspective view of the structure of one embodiment of the universal connector for micro memory cards according to the invention.

The present invention will be described in details with reference to the drawings.

As shown in FIGS. 1~8, the present invention provides a universal connector for micro memory cards comprising an insulating body 1 and a top metal casing 2.

The insulating body 1 has top and bottom planes, left and right sides, front and rear ends, wherein, a distance between the top plane and the bottom plane corresponds to the thickness of the memory cards; a distance between the left side and the right side corresponds to the width of the memory cards; a distance between the front end and the rear end corresponds to the length of the memory cards. A cavity for receiving the memory cards is provided in the insulating body 1 and an inserting port 3 is provided at the front end of the insulating body 1 so as to allow the memory cards to be inserted into the cavity.

The connector further comprises a first set of conductive terminals 4, a second set of conductive terminals 5 and a third set of conductive terminals 6. The first set of conductive terminals 4 for coupling a micro MMC card comprises ten conductive terminals horizontally arranged, wherein the first end of each conductive terminal is disposed in the cavity of the insulating body and the second end of each conductive terminal extends beyond the front end of the insulating body. The second set of conductive terminals 5 for coupling a micro SD card comprises eight conductive terminals horizontally arranged, wherein the first end of each conductive terminal is disposed in the cavity of the insulating body and the second end of each conductive terminal extends beyond the rear end of the insulating body. The third set of conductive terminals 6 for coupling a micro MS card comprises eleven conductive terminals horizontally arranged, wherein the first end of each conductive terminal is disposed in the cavity of the insulating body and the second end of each conductive terminal extends beyond the rear end of the insulating body. The second ends of the conductive terminals of the first set, the conductive terminals of the second set and the conductive terminals of the third set comprise the contact surfaces for being surface-welded to a print circuit board or contact pins for being in-line mounted to a print circuit, at the bottom surface of the insulating body.

The second ends of the second set of the conductive terminals 5 and the second ends of a portion of the third set of conductive terminals 6 are alternately arranged at the rear end of the insulating body 1, and the second ends of the other portion of the third set of conductive terminals are continuously distributed toward the right side of the insulating body. The pins of the conductive terminals of the three sets are arranged as FIG. 3. Specifically, the first pin 4-1, the second pin 4-2 . . . , and the tenth pin 4-10 correspond to the standard of the MMC card. The first pin 5-1, the second pin 5-2 . . . , and the eleventh pin 5-8 correspond to the standard of the SD card. The first pin 6-1, the second pin 6-2 . . . , and the eleventh pin 6-11 correspond to the standard of the MS card.

In order to meet the requirements of the standard of the MS card about the contact pins of power resource, the terminals for the anode 68 and the cathode 69 have fork-shaped structures which is step-shaped and has a long arm and a short arm for applying tearing force, and is different from the other terminals. In other words, the fork-shaped structure comprises a first branch and a second branch. The first branch is staggered with a distance at a crotch of the conductive terminal toward the bottom plane of the insulating body and then extends horizontally toward the front end of the insulating body. The second branch is staggered with a distance at a crotch of the conductive terminal toward the top plane of the insulating body and then extends horizontally toward the front end of the insulating body while bending toward the first branch, wherein, the second branch is longer than the first branch; the second branch is provided with a hunch which bends downwards initially and then bends back upwards or bends upwards initially and then bends back downwards along the horizontally extending toward the front end of the insulating body.

Furthermore, the first branch of the anode 68 and the first branch the cathode 69 are adjacent to each other, while the second branch of the anode 68 and the second branch of the cathode 69 are disposed outside. The second branch bends toward the first branch gradually and thereby ends of two branches are substantially aligned. Such a step-shaped fork can be directly pressed into the connector during the manufacture process, rather than be formed in the connector through molding.

A first backup conductive terminal 8 for the detection of the MMC card/SD card is further disposed near to the left side at the rear end of the insulating body.

A second backup conductive terminal 10 for the detection of the MMC card /SD card is further disposed near to the right side of the rear end of the insulating body, that's, corresponds to the ninth pin of the standard of the SD card.

A third backup conductive terminal 9 for the detection of the Micro MS card is further disposed near to the right side of the rear end of the insulating body, and adjacent to the outside of the second conductive terminal.

Such an arrangement of the conductive terminals allows the compact and convenience installation of the universal connector for micro memory cards to the circuit board of the electronic device, that's the connection between the connector and the circuit board through surface welding.

The top metal casing 2 covers on the insulating body 1, and contact surfaces for being surface-welded to the print circuit board and being grounded or contact pins 7 for being directly mounted to the print circuit on the bottom surface thereof and being grounded are provided at front ends on two sides of a bottom surface of the top metal casing 2.

Accordingly, the top metal casing can provide a shield function for the electrical connection between the terminals inside the connector and the memory cards.

The insulating body 1 is provided with a first grounding elastic piece 12 and a second grounding elastic piece 13 on the two sides thereof. The two elastic pieces are connected to the backup conductive terminals for the detection of the MMC card /SD card on the side end of the insulating body when the micro SD card or the micro MMC card is inserted into the cavity; the two elastic pieces are disconnected from the backup conductive terminals for the detection of the MS card when the micro MS card is inserted into the cavity.

Figure 6:
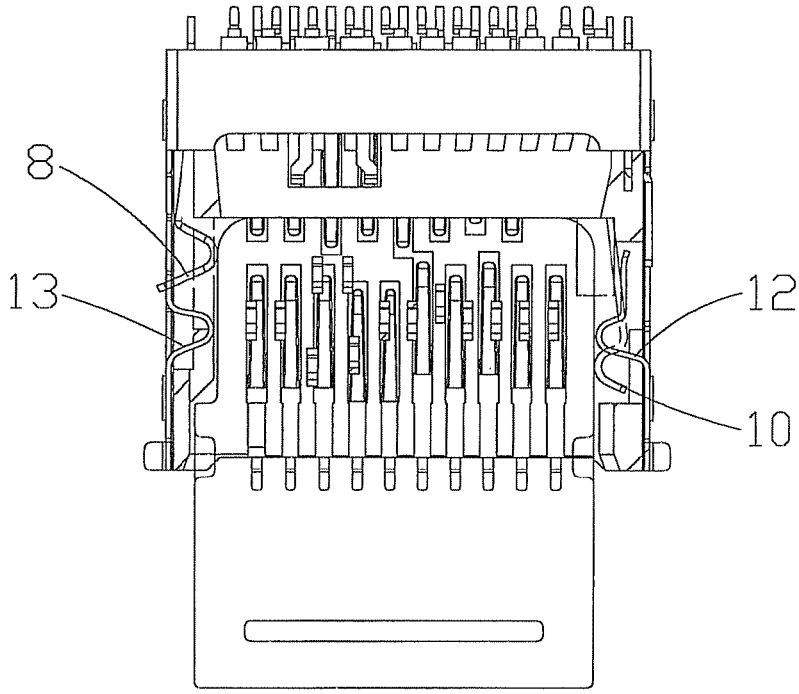
FIG. 6 is a schematically plan view of the universal connector for micro memory cards according to the invention, in which a Micro SD card /MMC card is inserted.

The process of inserting the Micro SD/MMC card is shown as FIG. 6. The first backup terminal 8 on the left side contacts the second grounding elastic piece 13, and the second backup terminal 10 on the right side contacts the first grounding elastic piece 12.

Figure 7:
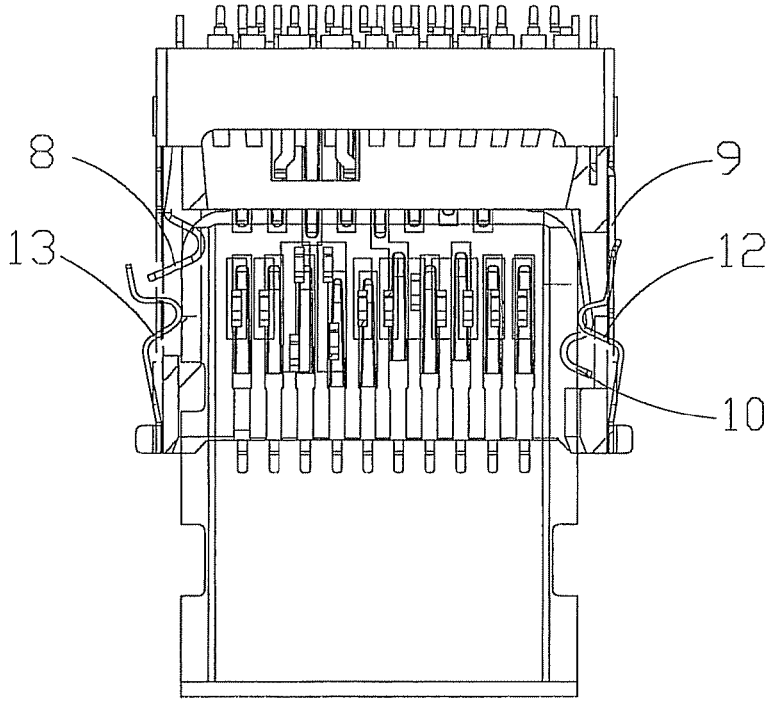
FIG. 7 is a schematically plan view of the universal connector for micro memory cards according to the invention, in which a Micro MS card is inserted.

The process of inserting the Micro MS card is shown as FIG. 7. The second grounding elastic piece 13 on the left side is pressed off such that the first backup terminal 8 does not contact the second grounding elastic piece 13. The first grounding elastic piece 12 on the right side is pressed off such that the second backup terminal 8 does not contact the first grounding elastic piece 12. The third backup terminal 9 contacts the first grounding elastic piece 12.

Such a structure can provide an effective handshaking signal for the match between the electronic device and the memory card.

Figure 8A:
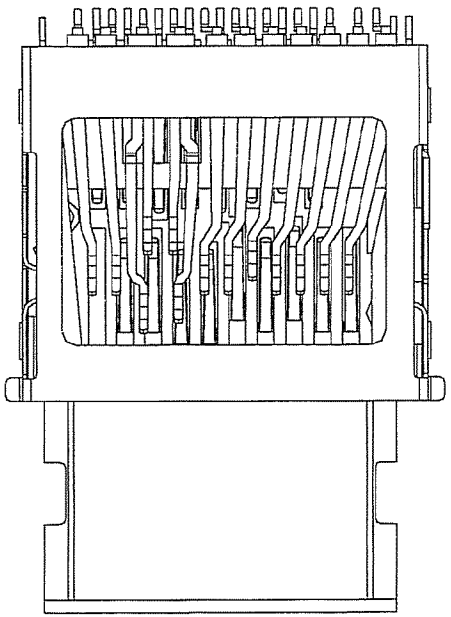
Figure 8B:
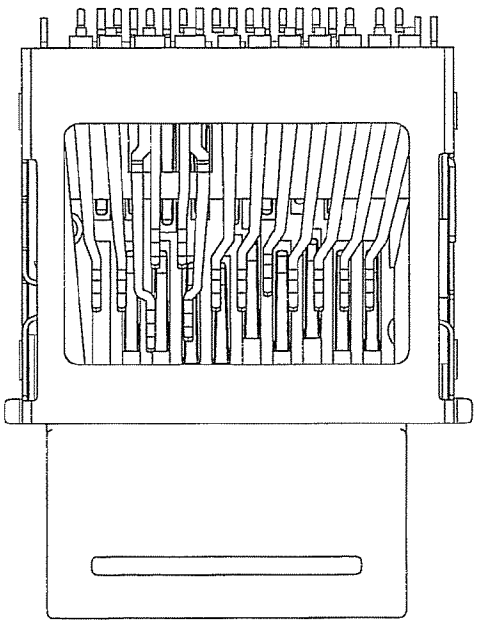
Figure 8C:
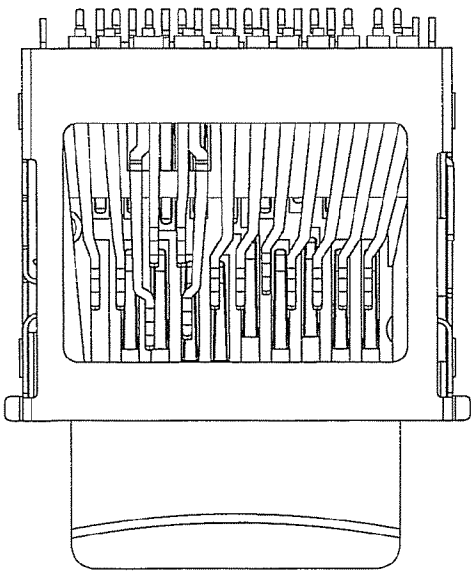

The state that the memory card is inserted into the connector is shown as FIG. 8*a*~8*c*, wherein, FIG. 8*a* is showing the state that a Micro MS card is inserted; FIG. 8*b* is showing the state that a Micro MMC card is inserted; and FIG. 8*c* is showing the state that a Micro SD card is inserted.

The first ends of the first set of the conductive terminals 4 and the first ends of the second set of the conductive terminals 5 are located under the memory card inserted into the cavity of the insulating body 1, whereas the first ends of the third set of conductive terminals 6 are located above the memory card inserted into the cavity of the insulating body 1.

The bottom surface of the insulating body 1 is provided with two protruding cylindrical post 11-1 and 11-2 for installation. The diameter of the protruding cylindrical post 11-1 is larger than that of protruding cylindrical post 11-2.

As above, the description has been given for the most preferred embodiments of the present invention. However, the present invention is not limited to the above description. Those skilled in the art can surely make various modification and changes thereto based on the purport of the present invention described in the appended claims or disclosed herein. Such modifications and changes are surely included in the scope.

What is claimed is:

1. A universal connector for micro memory cards, comprising:

an insulating body having top and bottom planes, left and right sides, front and rear ends forming a cavity for receiving the memory cards, and being provided with an inserting port at the front end thereof so as to allow the memory cards to be inserted into the cavity;

a first set of conductive terminals comprising ten conductive terminals for coupling a micro MMC card, wherein each conductive terminal is horizontally arranged, and comprises a first end which is disposed in the cavity of the insulating body for receiving the memory cards and a second end which extends beyond the front end of the insulating body;

a second set of conductive terminals comprising eight conductive terminals for coupling a micro SD card, wherein each conductive terminal is horizontally arranged, and comprises a first end which is disposed in the cavity of the insulating body for receiving the memory cards and a second end which extends beyond the rear end of the insulating body;

a third set of conductive terminals comprising eleven conductive terminals for coupling a micro MS card, wherein each conductive terminal is horizontally arranged, and comprises a first end which is disposed in the cavity of the insulating body for receiving the memory cards and a second end which extends beyond the rear end of the insulating body;

wherein the second ends of the conductive terminals of the first set, the conductive terminals of the second set and the conductive terminals of the third set comprise contact surfaces for being surface-welded to a print circuit board or contact pins for being in-line welded to a print circuit board, at the bottom surface of the insulating body.

2. The universal connector for micro memory cards as claim 1, further comprising a top metal casing covering on the insulating body; wherein the contact surface for being surface-mounted to the print circuit board and being grounded or the contact pins for being directly mounted to the print circuit board and being grounded are provided at front ends on two sides of a bottom surface of the top metal casing.

3. The universal connector for micro memory cards as claim 2, wherein the second ends of the conductive terminals of the second set and the second ends of a portion of the conductive terminals of the third set are alternately arranged at the read end of the insulating body, and the second ends of the other portion of the conductive terminals of the third set are continuously distributed toward the right side of the insulating body.

4. The universal connector for micro memory cards as claim 3, wherein a first backup conductive terminal for the detection of an MMC card /SD card is further disposed near to the left side at the rear end of the insulating body.

5. The universal connector for micro memory cards as claim 4, wherein a second backup conductive terminal for the detection of an MMC card /SD card is further disposed near to the right side of the rear end of the insulating body.

6. The universal connector for micro memory cards as claim 5, wherein a third backup conductive terminal for the detection of the MS card is further disposed near to the right side at the rear end of the insulating body and adjacent to the outside of the second backup conductive terminal.

7. The universal connector for micro memory cards as claim 6, wherein metal elastic pieces attached to the top metal casing are further disposed on both the left side and the right side of the insulating body; the two elastic pieces are connected to the backup conductive terminals for the detection of an MMC card /SD card on the side end of the insulating body when the micro SD card or the micro MMC card is inserted into the cavity; the two elastic pieces are disconnected from the backup conductive terminal for the detection of the MS card when the micro MS card is inserted into the cavity.

8. The universal connector for micro memory cards as claim 1, wherein two of the conductive terminals of the third set corresponding to a power resource for the Micro MS card have a fork-shaped structure which is step-shaped.

9. The universal connector for micro memory cards as claim 8, wherein the forked-shape structure comprises:

a first branch which is staggered with a distance at a crotch of the conductive terminal toward the bottom plane of the insulating body and then extends horizontally toward the front end of the insulating body; and a second branch which is staggered with a distance at a crotch of the conductive terminal toward the top plane of the insulating body and then extends horizontally toward the front end of the insulating body while bending toward the first branch;

the second branch is longer than the first branch;

the second branch is provided with a hunch which bends downwards initially and then bends back upwards or bends upwards initially and then bends back downwards along the horizontally extending direction toward the front end of the insulating body.

10. The universal connector for micro memory cards as claim 9, wherein the bottom surface of the insulating body is provided with two cylindrical posts for installation and the diameters of the two posts are different from each other.

* * * * *